US008540871B2

(12) United States Patent
Zhan et al.

(10) Patent No.: US 8,540,871 B2
(45) Date of Patent: Sep. 24, 2013

(54) DENITRIFICATION OF A HYDROCARBON FEED

(75) Inventors: Bi-Zeng Zhan, Albany, CA (US); Akshay Verma, Richmond, CA (US); Zunqing He, San Rafael, CA (US); Zhen Zhou, Emeryville, CA (US); Marcus Dutra e Mello, Moraga, CA (US); Sheila Yeh, Orinda, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 549 days.

(21) Appl. No.: 12/847,107

(22) Filed: Jul. 30, 2010

(65) Prior Publication Data

US 2012/0024751 A1 Feb. 2, 2012

(51) Int. Cl.
*C10G 25/12* (2006.01)

(52) U.S. Cl.
USPC ..... 208/254 R; 208/208 R; 208/236; 208/250; 208/299; 208/302; 502/400; 502/401

(58) Field of Classification Search
USPC ..... 208/208 R, 236, 250, 254 R, 299, 208/302; 502/400–401
See application file for complete search history.

(56) References Cited

U.S. PATENT DOCUMENTS

| | | | | |
|---|---|---|---|---|
| 6,852,229 | B2 | 2/2005 | Mehnert et al. | |
| 7,198,712 | B2 | 4/2007 | Olivier-Bourbigou et al. | |
| 7,553,406 | B2 | 6/2009 | Wasserscheid et al. | |
| 7,727,376 | B2 * | 6/2010 | Adams et al. | 208/49 |
| 7,749,377 | B2 | 7/2010 | Serban et al. | |
| 2002/0130062 | A1 * | 9/2002 | Wismann et al. | 208/189 |
| 2002/0169071 | A1 * | 11/2002 | Sauvage et al. | 502/150 |
| 2002/0198100 | A1 | 12/2002 | Mehnert et al. | |
| 2004/0178122 | A1 * | 9/2004 | Karas et al. | 208/196 |
| 2007/0205138 | A1 * | 9/2007 | Wardle et al. | 208/57 |
| 2009/0264691 | A1 | 10/2009 | Jess et al. | |
| 2010/0116712 | A1 * | 5/2010 | Dziabala et al. | 208/57 |
| 2010/0116713 | A1 | 5/2010 | Ortega Garcia et al. | |

FOREIGN PATENT DOCUMENTS

| | | | |
|---|---|---|---|
| EP | 0079778 | A1 | 5/1983 |
| WO | WO02/34863 | | 5/2002 |
| WO | WO 2010/116165 | A2 * | 10/2010 |

OTHER PUBLICATIONS

Xie, L-L et al. (2008). Green Chemistry, 10, 524-531.*
Couper, J.R. et al (2005). Chemical Process Equipment Selection and Design, 3rd edition, Elsevier, 501-520.*
Xie, L. et al., Selective Extraction and Identification of Neutral Nitrogen Compounds Contained in Straight-Run Diesel Feed Using Chloride Based Ionic Liquid, 2008, *Ind. Eng. Chem. Res. 47*, 8801-8807.

(Continued)

*Primary Examiner* — Brian McCaig
(74) *Attorney, Agent, or Firm* — Richard J. Schulte

(57) ABSTRACT

A denitrification method is disclosed for removing nitrogen compounds from a hydrocarbon feed in which the feed is contacted with an adsorbent including an organic heterocyclic salt deposited on a porous support. Additionally, a method for hydrotreating a hydrocarbon feed which includes a hydroprocessing step is disclosed, wherein prior to hydroprocessing, the feed is contacted with an adsorbent including an organic heterocyclic salt deposited on a support. Additionally, a method for producing a lube oil which includes isomerization dewaxing of a base oil fraction is disclosed, wherein prior to the isomerization dewaxing step, the base oil fraction is contacted with an adsorbent including an organic heterocyclic salt deposited on a support.

15 Claims, 3 Drawing Sheets

(56) References Cited

OTHER PUBLICATIONS

Xie, L. et al., Selective Extraction of Neutral Nitrogen-Containing Compounds from Straight-Run Diesel Feed Using Poly-Supported Ionic Liquid Moieties, 2009,*Ind. Eng. Chem. Res. 48*, 3973-3977.

Valkenberg, et al., Immobilisation of Chloroaluminate Ionic Liquids on Silica Materials, 2001, Topics in Catalysis 14, 1-4.

PCT International Preliminary Report on Patentability and Written Opinion of the International Searching Authority, International Application No. PCT/US2011/043733, Feb. 13, 2013.

U.S. Appl. No. 13/180,629, filed Jul. 12, 2011, Akshay Verma, et al.

* cited by examiner

DENITRIFICATION OF A HYDROCARBON FEED

FIELD

The present disclosure is directed generally to a process for removing nitrogen compounds from a hydrocarbon feed by contacting the feed with an adsorbent material.

BACKGROUND

Environmental regulations increasingly mandate liquid fuels containing very low levels of sulfur and nitrogen species. Hydrotreating is the most often used method for reducing sulfur and nitrogen content in a hydrocarbon feed. In general, harsher hydrotreating process conditions and more advanced catalysts are required to further reduce sulfur from about 20 ppm to less than about 1 ppm because of the concentrated recalcitrant sulfur and nitrogen species to be reduced, including, for instance, 4,6-dimethyl dibenzothiophene, trimethyl dibenzothiophene, methyl, ethyl dibenzothiophene, carbazole and alkyl-substituted carbazole. The harsh hydrotreating conditions in turn result in further hydrocracking of diesel and jet fuel to $C_1$-$C_4$ gas and naphthene products, which may be undesired, as well as undesirably high hydrogen consumption.

It would be desirable to develop a process to reduce nitrogen compounds in a hydrocarbon feed while avoiding the aforementioned problems.

It is known that prior removal of nitrogen compounds from the hydrocarbon feed results in increasing the sulfur removal capacity, since both nitrogen and sulfur compounds target the same adsorption and/or hydrodesulfurization sites on the adsorbent or hydroprocessing catalyst and nitrogen being more polar is preferentially adsorbed.

It would additionally be desirable to develop a process by which refractory nitrogen compounds, such as carbazole and indole and their alkyl substitutes would be removed from liquid fuels, resulting in higher capacity to reduce sulfur by either adsorption or hydrodesulfurization.

SUMMARY

One embodiment relates to a method for removing nitrogen compounds from a hydrocarbon feed by contacting the feed with an adsorbent including an organic heterocyclic salt deposited on a porous support, resulting in a product containing a reduced amount of nitrogen as compared with the feed.

Another embodiment relates to a method for hydroprocessing a hydrocarbon feed in which the feed is contacted with an adsorbent including an organic heterocyclic salt deposited on a support to form an intermediate stream, and the intermediate stream is subsequently contacted with a hydrocracking catalyst.

Another embodiment relates to a method for producing a lube oil in which a hydrocarbon feed is contacted with a hydrocracking catalyst, the hydrocracked feed is separated into at least one light fraction and a base oil fraction, and the base oil fraction is contacted with a bed of isomerization dewaxing catalyst, wherein prior to contacting the feed with the isomerization dewaxing catalyst, the base oil fraction is contacted with an adsorbent including an organic heterocyclic salt deposited on a support.

DETAILED DESCRIPTION

Figure 1:
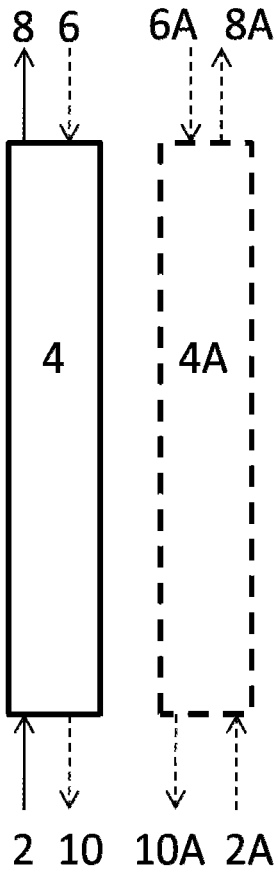
FIG. 1 illustrates one embodiment of a process for denitrification utilizing an adsorbent and optional regeneration of the adsorbent.

The present disclosure provides a process for reducing nitrogen compounds in a hydrocarbon feed, also referred to as denitrification. The present process is suitable for treating hydrocarbon feeds containing greater than 1 ppm nitrogen. In one embodiment, the feed is a hydrocarbon having a boiling temperature within a range of 93° C. to 649° C. (200° F. to 1200° F.). Exemplary hydrocarbon feeds include petroleum fractions such as hydrotreated and/or hydrocracked products, coker products, straight run feed, distillate products, FCC bottoms, atmospheric and vacuum bottoms, vacuum gas oils and unconverted oils including crude oil. In one embodiment, the hydrocarbon feed is a hydrotreated base oil or unconverted oil fraction containing between 3 ppm and 6000 ppm nitrogen. In another embodiment, the feed contains greater than 400 ppm nitrogen. In another embodiment, the feed contains greater than 300 ppm nitrogen. In another embodiment, the feed contains greater than 200 ppm nitrogen. In another embodiment, the feed contains greater than 100 ppm nitrogen. In another embodiment, the feed contains greater than 50 ppm nitrogen.

In one embodiment, as a result of the denitrification process, the product has less than 1000 ppm nitrogen. In another embodiment, the product has less than 500 ppm nitrogen. In another embodiment, the product has less than 100 ppm nitrogen. In another embodiment, the product has less than 1 ppm nitrogen. In another embodiment, the product has less than the detectable limit of nitrogen. In one embodiment, the adsorbent has been found to have higher selectivity for nitrogen compounds than for aromatics or sulfur compounds.

The feed may include nitrogen-containing compounds such as, for example, imidazoles, pyrazoles, thiazoles, isothiazoles, azathiozoles, oxothiazoles, oxazines, oxazolines, oxazoboroles, dithiozoles, triazoles, selenozoles, oxaphospholes, pyrroles, boroles, furans, pentazoles, indoles, indolines, oxazoles, isooxazoles, isotriazoles, tetrazoles, thiadiazoles, pyridines, pyrimidines, pyrazines, pyridazines, piperazines, piperidines, morpholenes, phthalzines, quinazolines, quinoxalines, quinolines, isoquinolines, thazines, oxazines, and azaannulenes. In addition acyclic organic systems are also suitable. Examples include, but are not limited to amines (including amidines, imines, guanidines), phosphines (including phosphinimines), arsines, stibines, ethers, thioethers, selenoethers and mixtures of the above.

The denitrification process includes contacting the hydrocarbon feed with an organic heterocyclic salt deposited on a porous support. In one embodiment, the organic heterocyclic salt has a general formula of:

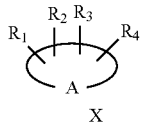

wherein:

A is a nitrogen cation containing heterocyclic group selected from the group consisting of imidazolium, pyrazolium, 1,2,3-triazolium, 1,2,4-triazolium, pyridinium, pyrazinium, pyrimidinium, pyridazinium, 1,2,3-triazinium, 1,2,4-triazinium, 1,3,5-triazoinium, quinolinium, and isoquinolinium;

$R_1$, $R_2$, $R_3$, and $R_4$ are substituent groups attached to the carbon or nitrogen of the heterocyclic group A, independently selected from the group consisting of hydroxyl, amino, acyl, carboxyl, linear unsubstituted $C_1$-$C_{12}$ alkyl groups, branched unsubstituted $C_1$-$C_{12}$ alkyl groups, linear $C_1$-$C_{12}$ alkyl groups substituted with oxy, amino, acyl, carboxyl, alkenyl, alkynyl, trialkoxysilyl, and alkyldialkoxysilyl groups, branched substituted $C_1$-$C_{12}$ alkyl groups substituted with oxy, amino, acyl, carboxyl, alkenyl, alkynyl, trialkoxysilyl, and alkyldialkoxysilyl groups; and X is an inorganic or organic anion selected from the group consisting of fluoride, chloride, bromide, iodide, aluminum tetrachloride, heptachlorodialuminate, sulfite, sulfate, phosphate, phosphoric acid, monohydrogen phosphate, dihydrogen phosphate, bicarbonate, carbonate, hydroxide, nitrate, trifluoromethanesulfonate, sulfonate, phosphonate, carboxylate groups of $C_2$-$C_{18}$ organic acids, and chloride or fluoride substituted carboxylate groups.

The organic heterocyclic salt can also include ionic liquids. Ionic liquids are liquids containing predominantly anions and cations. The cations associated with ionic liquids are structurally diverse, but generally contain one or more nitrogens that are part of a ring structure and can be converted to a quaternary ammonium. Examples of these cations include pyridinium, pyridazinium, pyrimidinium, pyrazinium, imidazolium, pyrazolium, oxazolium, triazolium, thiazolium, piperidinium, pyrrolidinium, quinolinium, and isoquinolinium. The anions associated with ionic liquids can also be structurally diverse and can have a significant impact on the solubility of the ionic liquids in different media.

In one embodiment, the organic heterocyclic salt is a carboxylated ionic liquid. As used herein, the term "carboxylated ionic liquid" shall denote any ionic liquid comprising one or more carboxylate anions. Carboxylate anions suitable for use in the carboxylated ionic liquids of the present process include, but are not limited to, $C_1$ to $C_{20}$ straight- or branched-chain carboxylate or substituted carboxylate anions. Examples of suitable carboxylate anions for use in the carboxylated ionic liquid include, but are not limited to, formate, acetate, propionate, butyrate, valerate, hexanoate, lactate, oxalate, or chloro-, bromo-, fluoro-substituted acetate, propionate, or butyrate and the like. In one embodiment, the anion of the carboxylated ionic liquid is a $C_2$ to $C_6$ straight-chain carboxylate. Furthermore, the anion can be acetate, propionate, butyrate, or a mixture of acetate, propionate, and/or butyrate.

Examples of suitable carboxylated ionic liquids include, but are not limited to, 1-ethyl-3-methylimidazolium acetate, 1-ethyl-3-methylimidazolium propionate, 1-ethyl-3-methylimidazolium butyrate, 1-butyl-3-methylimidazolium acetate, 1-butyl-3-methylimidazolium propionate, 1-butyl-3-methylimidazolium butyrate, or mixtures thereof.

The organic heterocyclic salt is deposited on a porous support material having an average pore diameter of between 0.5 nm and 100 nm. In one embodiment, the pores of the support material have an average pore diameter of between 0.5 nm and 50 nm. In one embodiment, the pores of the support material have an average pore diameter of between 0.5 nm and 20 nm. The porous support material has a pore volume of between 0.1 and 3 $cm^3/g$. Suitable materials include molecular sieves with 8, 10, and 12-rings, silica, alumina, silica-alumina, zirconia, titanium oxide, magnesium oxide, thorium oxide, beryllium oxide, carbon and mixtures thereof. Example of molecular sieves include 13X, zeolite-Y, USY, ZSM-5, ZSM-22, ZSM-23, ZSM-35, ZSM-48, MCM-22, MCM-35, MCM-58, SAPO-5, SAPO-11, SAPO-35, VPI-5. If carbon is selected as the support material, the carbon support can have a BET surface area of between 200 $m^2/g$ and 3000 $m^2/g$. In another embodiment, the carbon support has a BET surface area of between 500 $m^2/g$ and 3000 $m^2/g$. In another embodiment, the carbon support has a BET surface area of between 800 $m^2/g$ and 3000 $m^2/g$. If the support is selected from silica, alumina, silica-alumina, clay and mixtures thereof, the support can have a BET surface area of between 50 $m^2/g$ and 1500 $m^2/g$. In another embodiment, the support selected from silica, alumina, clay and mixtures thereof has a BET surface area of between 150 $m^2/g$ and 1000 $m^2/g$. In another embodiment, the support selected from silica, alumina, clay and mixtures thereof has a BET surface area of between 200 $m^2/g$ and 800 $m^2/g$.

Deposition of the organic heterocyclic salts on the support can be carried out in various ways including, but not limited to, impregnation, grafting, polymerization, sol gel method, encapsulation or pore trapping. In one suitable method, the support maternal is impregnated with an organic heterocyclic salt diluted with an organic solvent, such as acetone. The impregnation followed by the evaporation of the solvent results in a uniform and thin organic heterocyclic salt layer on the support material. When organic heterocyclic salts prepared in such a manner are used in a liquid phase process, a bulk solvent that is miscible with the organic heterocyclic salt is chosen.

The deposition of organic heterocyclic salt onto a porous support is preferred through grafting by covalent bond interaction in a format of "—X—Si—O-M-," where M is a framework atom of porous material and X is a species which acts a bridge to connect organic heterocyclic cations. In one embodiment, the X is carbon atom.

The temperature of the process can range from 0° C. to 200° C., alternatively from 10° C. to 150° C. In one embodiment, no external heat is added to the adsorber. The pressure within the adsorber can range between 1 bar and 10 bars. The liquid hourly space velocity (LHSV) can vary between 0.1 and 50 $h^{-1}$, alternatively between 1 and 10 $h^{-1}$. In one embodiment, no mechanical stirring, mixing or agitation is applied to the process.

One embodiment is illustrated in FIG. 1. Denitrification of the feed 2 is conducted as a continuous process in a fixed bed adsorber 4 which can have a length to diameter ratio of between 2 and 50. The adsorbent is physically stationary within the adsorber with no mechanical mixing during the process. In order to avoid channeling through the adsorbent bed and to ensure good mass transfer, the feed can be introduced to the adsorber at the bottom end and flows upward such that the product 8 is recovered at the top end of the adsorber. In an alternative embodiment, the feed and the adsorbent are contacted in a batch process within a vessel. Other embodiments utilize alternative types of equipment, including, but not limited to, fluidized bed and rotary bed absorbers, for example.

Periodically, the denitrification process can be interrupted so that the adsorbent can be regenerated in order to restore its capacity for nitrogen removal. After flow of feed 2 has ceased, a blowdown step is conducted in which the adsorbent is dried to remove excess hydrocarbon from the adsorbent. In one embodiment, this is accomplished using an inert gas purge, e.g., nitrogen. In another embodiment, this is accomplished using air purge. In another embodiment, this is accomplished using a refinery gas stream comprising $C_1$ to $C_6$ alkanes. The adsorbent can then be regenerated at a temperature between ambient conditions and an elevated temperature, alternatively between room temperature and 200° C., by contacting the adsorbent with an aromatics-containing regenerant such as, for example, toluene. Following the ceasing of the flow of regenerant, a second blowdown step is conducted in which the adsorbent is dried to remove excess regenerant. As shown in FIG. 1, the regenerant 6 can be introduced to the adsorber at the top end and removed as stream 10 from the adsorber at the bottom end. In one embodiment as shown in FIG. 1, a pair of adsorbers 4 and 4A are used in order to keep one adsorber in operation while the other adsorber is shut down for regeneration. The duration of the regeneration step is sufficient to allow the desired reactivation of the adsorbent. The adsorbent is capable of regeneration even after multiple regeneration steps. In one embodiment, the adsorbent is capable of complete regeneration. By "complete regeneration" is meant a recovery of at least 90% of the pre-regeneration denitrification capacity of the adsorbent after regeneration.

The denitrification process can be integrated with a number of other processing steps, including, but not limited to, hydrotreating, hydrocracking, hydroisomerization and/or hydrodemetallization. By first removing nitrogen compounds, the process increases the ability to remove sulfur species from the feed. While not wishing to be bound by theory, it is believed that removing nitrogen compounds from the feed results in increased sulfur removal capacity by adsorption and/or hydrodesulfurization processes since both nitrogen and sulfur target the same active sites on adsorbents and hydroprocessing catalysts and nitrogen is preferentially adsorbed.

Figure 2:
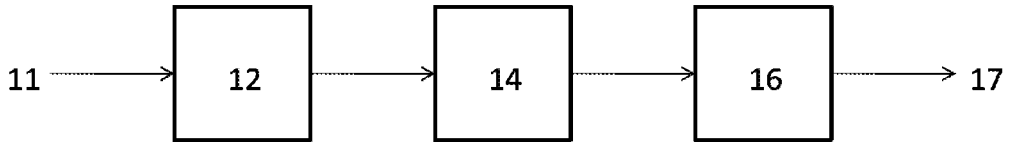
FIG. 2 illustrates one embodiment of a process for hydroprocessing a vacuum gas oil feed which includes a denitrification process.

As one example of an integrated process including the denitrification process, as illustrated in FIG. 2, the denitrification process is used to treat a vacuum gas oil (VGO) feed 11 prior to the VGO contacting a hydrotreating catalyst bed 14 and subsequently a hydrocracking catalyst bed 16 in order to yield product 17. According to this embodiment, the presence of the denitrification bed 12 allows greater flexibility in choice of feedstock. Additionally, catalyst life is extended since nitrogen compounds act as a poison to the catalysts. Milder conditions may be run in the hydrocracking processes, which may reduce operating costs and increase liquid yield. In one embodiment, the hydrocracking bed 16 is optionally bypassed or eliminated.

Figure 3:
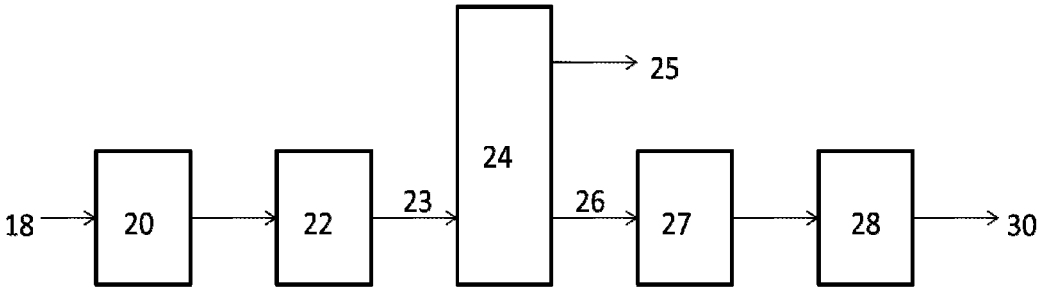
FIG. 3 illustrates one embodiment of a process for producing lube oil which includes a denitrification process.

Another example of an integrated process including the denitrification process is illustrated in FIG. 3. In a process for converting a VGO feed 18 to a lube oil 30, a denitrification bed 27 according to the present process is included between distillation column 24 and a bed of isomerization dewaxing catalyst 28. The VGO is first contacted with a hydrotreating catalyst bed 20 and subsequently a hydrocracking catalyst bed 22, and the resulting stream 23 is separated into at least one light fraction 25 and a base oil fraction 26. The base oil fraction 26 is contacted with an adsorbent comprising an organic heterocyclic salt deposited on a porous support in denitrification bed 27 prior to contacting the base oil fraction with a bed of isomerization dewaxing catalyst 28, thus forming lube oil stream 30. The product stream can optionally be subjected to a subsequent hydrofinishing step (not shown) to saturate aromatic compounds in the stream. The denitrification bed removes nitrogen compounds from the base oil stream, thus resulting in the ability to use mild operating conditions in the isomerization dewaxing process and increasing lube oil yield.

In another example of an integrated process including the denitrification process, the denitrification process can also be used as a finishing step for improving the thermal stability of a jet fuel.

Test Methods

Surface area of porous materials is determined by $N_2$ adsorption at its boiling temperature. BET surface area is calculated by the 5-point method at $P/P_0$=0.050, 0.088, 0.125, 0.163, and 0.200. Samples are first pre-treated at a temperature in the range of 200 to 400° C. for 6 hours in the presence of flowing, dry $N_2$ so as to eliminate any adsorbed volatiles like water or organics.

Mesopore pore diameter is determined by $N_2$ adsorption at its boiling temperature. Mesopore pore diameter is calculated from $N_2$ isotherms by the BJH method described in E. P. Barrett, L. G. Joyner and P. P. Halenda, "The determination of pore volume and area distributions in porous substances. I. Computations from nitrogen isotherms." J. Am. Chem. Soc. 73, pp. 373-380, 1951. Samples are first pre-treated at a temperature in the range of 200 to 400° C. for 6 hours in the presence of flowing, dry $N_2$ so as to eliminate any adsorbed volatiles like water or organics.

Total pore volume is determined by $N_2$ adsorption at its boiling temperature at P/P0=0.990. Samples are first pre-treated at a temperature in the range of 200 to 400° C. for 6 hours in the presence of flowing, dry $N_2$ so as to eliminate any adsorbed volatiles like water or organics.

Denitrification capacity was measured with a fixed-bed adsorber loaded with an adsorbent in a continuous flow mode except elsewhere indicated. Hydrocarbon feed A was contacted with adsorbent at 10 LHSV and at ambient temperature and pressure. Denitrification capacity was calculated at 1 ppm N breakthrough based on a combination of indole and carbazole concentration in the effluent liquid stream on a weight percent basis as follows:

$$\text{Denitrification Capacity(wt \%)} = (N \text{ adsorbed in grams} / \text{Amount of adsorbent in grams}) \times 100$$

wherein:

$$N \text{ adsorbed in grams} = \text{feed flow rate(cc/min)} \times \text{runtime at 1 ppm } N \text{ breakthrough(min)} \times \text{feed density(g/cc)} \times \text{feed } N \text{ concentration(ppmw/g)} \times 10^{-6} \text{(g/ppmw)}$$

EXAMPLES

Example 1

Preparation of Adsorbent A

Activated carbon (obtained from MeadWestvaco Corporation, Richmond, Va.) was impregnated by the incipient wetness method with an acetone solution containing 3-butyl-1-methyl-imidazolium acetate to provide 40 wt % loading based on the bulk dry weight of the finished adsorbent. The solution was added to the carbon support gradually while tumbling the carbon. When the solution addition was completed, the carbon was soaked for 2 hours at ambient temperature. Then the carbon was dried at 176° F. (80° C.) for 2 hours in vacuum, and cooled to room temperature for adsorption application.

Example 2

Preparation of Adsorbent B

An acid-pretreated carbon support was formed by gradually adding 50 grams activated carbon to a 1000 mL nitric acid solution (6 M). The mixture was agitated for 4 hours at room temperature (approximately 20° C.). After filtration, the carbon was washed with deionized water until the pH value of the wash water approached 6. The treated carbon was dried at 392° F. (200° C.) for 4 hours in flowing dry air, and cooled to room temperature.

The acid-pretreated carbon was then impregnated by the incipient wetness method with an acetone solution containing 3-butyl-1-methyl-imidazolium acetate to provide 40 wt % loading based on the bulk dry weight of the finished adsorbent. The solution was added to the acid-treated carbon support gradually while tumbling the support. When the solution addition was completed, the carbon was soaked for 2 hours at ambient temperature. Then the carbon was dried at 176° F. (80° C.) for 2 hours in vacuum, and cooled to room temperature.

Example 3

Preparation of Adsorbent C

A silica alumina extrudate was prepared by mixing well 69 parts by weight silica-alumina powder (Siral-40, obtained from Sasol) and 31 parts by weight pseudo boehmite alumina powder (obtained from Sasol). A diluted $HNO_3$ acid aqueous solution (1 wt. %) was added to the powder mixture to form an extrudable paste. The paste was extruded in 1/16" (1.6 mm) cylinder shape, and dried at 250° F. (121° C.) overnight. The dried extrudates were calcined at 1100° F. (593° C.) for 1 hour with purging excess dry air, and cooled to room temperature. The sample had a surface area of 500 $m^2/g$ and pore volume of 0.90 mL/g by $N_2$-adsorption at its boiling point.

The calcined extrudates were impregnated by the incipient wetness method with an acetone solution containing 3-butyl-1-methyl-imidazolium acetate to provide 40 wt % ionic liquid based on the bulk dry weight of the finished adsorbent. The acetone solution was added to the silica alumina extrudates gradually while tumbling the extrudates. When the solution addition was completed, the extrudates were soaked for 2 hours at room temperature. Then the extrudates were dried at 176° F. (80° C.) for 2 hours in vacuum, and cooled to room temperature.

Example 4

Preparation of Adsorbent D

In a distillation apparatus, 30 g of silica (Silica gel 60, having an average pore size of 6 nm, obtained from Alfa Aesar, Ward Hill, Mass.) was dispersed in 100 mL dried toluene. 67 g 1-(tri-ethoxy-silyl)-propyl-3-methyl-imidazolium chloride was then gradually added. The mixture was stirred at 110° C. for 16 hours. After filtration, the excess of 1-(tri-ethoxy-silyl)-propyl-3-methyl-imidazolium chloride was removed by extraction with boiling $CH_2Cl_2$ in a Soxhlet apparatus. The remaining powder was dried in vacuum at 120° C. for two days. The content of imidazolium ion grafted on silica was 24 wt. % by CHN analysis (bulk dry adsorbent). The grafting of the imidazolium ion to silica surface can be represented schematically by:

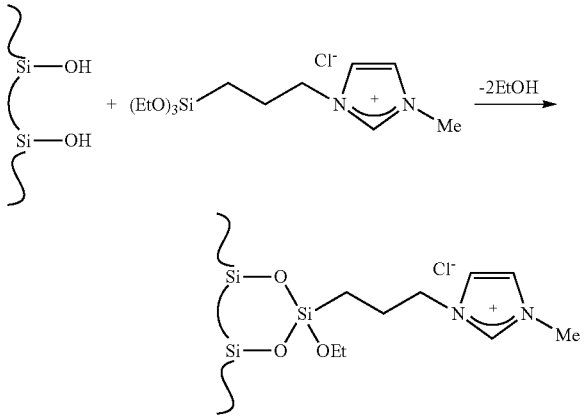

Example 5

Preparation of Adsorbent E

The preparation method was the same as that for Adsorbent D except for the replacement of silica gel with wide pore (150 Å (15 nm)) silica gel available from Alfa Aesar (Ward Hill, Mass.) as item number 42726. The content of imidazolium ion deposited on silica was 17 wt. % by CHN analysis (bulk dry adsorbent).

Example 6

Feeds for Denitrification

Table 1 shows the S and N concentration of two feeds used for the evaluation of the denitrification capacity of Adsorbents A-E.

TABLE 1

| | Feed A | Feed B |
|---|---|---|
| Total S, ppm wt | 100 | 175 |
| Total N, ppm wt | 13 | 13 |
| Nitrogen in Indole | 4 ppm-wt | 4 ppm-wt |
| Nitrogen in Carbazole | 4 ppm-wt | 4 ppm-wt |
| Nitrogen in 2-Methyl Indoline | 5 ppm-wt | 5 ppm-wt |

Example 7

Denitrification Capacity of Adsorbents A to E

Table 2 compares the denitrification capacities of Adsorbents A-E, as well as silica gel 60 and acid-treated carbon supports. The denitrification was conducted in a fixed bed adsorber using the Feed A at 12.0 WHSV, and ambient conditions.

Adsorbent B (imidazolium ion deposited on acid-treated carbon) had the highest denitrification capacity of 0.39 mole N per mole imidazolium ion or 1.1 wt. % per gram adsorbent. Table 2 also shows the effect of the pore size of silica support on the denitrification capacity. Adsorbent D with large pore silica (150 Å) gave a denitrification capacity of 0.22 mole N/mole imidazolium ion, higher than that of 0.17 on Adsorbent E with 60 Å silica gel.

TABLE 2

| Adsorbent | Denitrification Capacity (wt. %, N adsorbed/adsorbent) | Denitrification Capacity (mole N adsorbed/mole adsorbent) |
|---|---|---|
| Silica Gel 60 | 0.04 | — |
| Acid-Treated Carbon | 0.06 | — |
| Adsorbent A | 0.68 | 0.24 |
| Adsorbent B | 1.1 | 0.39 |
| Adsorbent C | 0.60 | 0.21 |
| Adsorbent D | 0.25 | 0.17 |
| Adsorbent E | 0.25 | 0.22 |

Example 8

Denitrification Operating Modes

Table 3 shows the removal of N compounds in Feed A by Adsorbent D by a solid-liquid extraction method. This suggests that denitrification can be performed in the batch mode although much higher denitrification capacity is achieved in the fixed bed continuous flow mode.

TABLE 3

| Adsorption Operating Mode | Fixed Bed Continuous with Feed A | Solid-Liquid Extraction - Batch with Feed A[a] |
|---|---|---|
| Denitrification Capacity (mole N/mole imidazolium ion) | 0.17 | 0.02 |

[a]Ratio of Feed A to Adsorbent D = 2.5/0.5 by weight, agitated at 25° C. for 8 hours

Example 9

Regeneration of the Adsorbent

Figure 4:
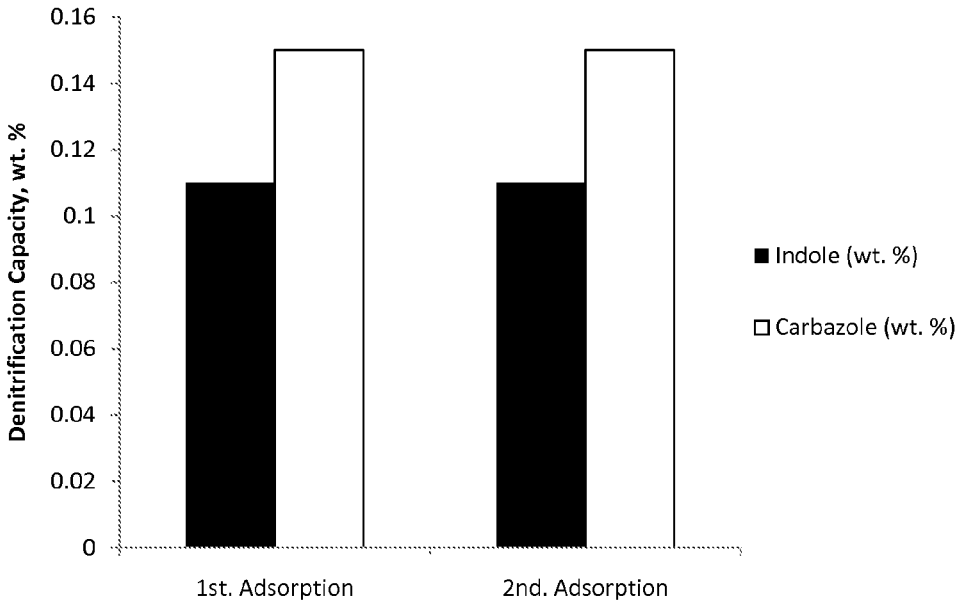
FIGS. 4 and 5 illustrate the denitrification capacity before and after regeneration of adsorbents used in a denitrification process.
Figure 5:
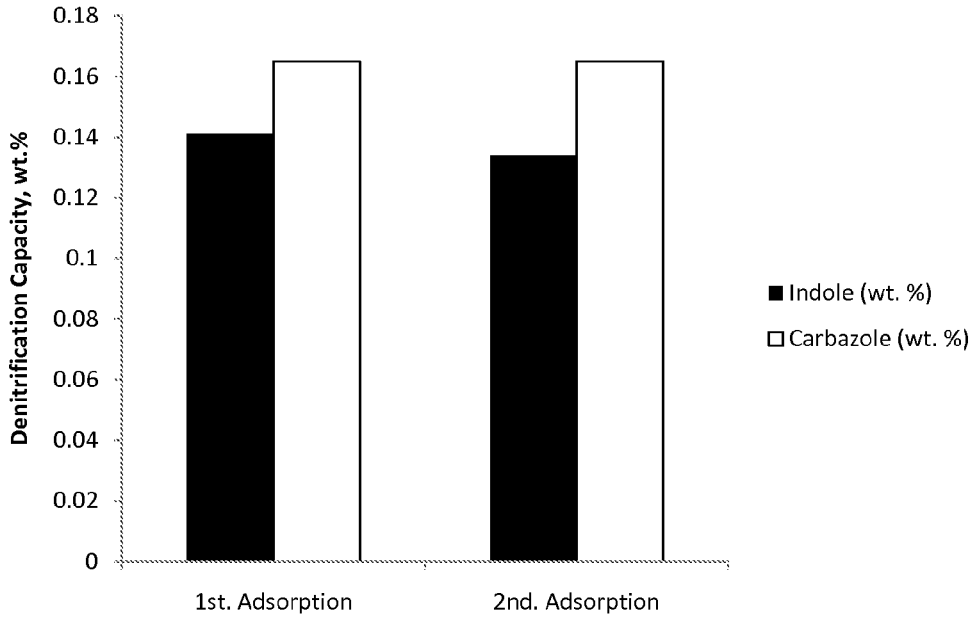

FIGS. 4 and 5 show the denitrification capacities of Adsorbent D in the first and second cycle for removing neutral nitrogen compounds in Feed A and Feed B, respectively. Denitrification was conducted in a continuous flow fixed bed adsorber at LHSV of 10 $h^{-1}$, and ambient temperature and pressure. The denitrification capacity was calculated at 1 ppm N breakthrough (combination of indole and carbazole) in the effluent liquid stream. After the uptake, the adsorbent was regenerated online with toluene at LHSV of 50 $h^{-1}$ and ambient conditions.

The denitrification capacity of Adsorbent D is slightly higher with Feed B than Feed A. This is attributed to the slight difference in their aromatics content. FIGS. 4 and 5 illustrate that Adsorbent D is fully regenerable by toluene solvent wash after the first uptake. There was no detectable difference in denitrification capacity between the first and second runs of the adsorption process, indicating complete regeneration. This may be due to the covalent bond between the imidazolium ion and the silica support.

For the purpose of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained and/or the precision of an instrument for measuring the value, thus including the standard deviation of error for the device or method being employed to determine the value. The use of the term "or" in the claims is used to mean "and/or" unless explicitly indicated to refer to alternatives only or the alternative are mutually exclusive, although the disclosure supports a definition that refers to only alternatives and "and/or." The use of the word "a" or "an" when used in conjunction with the term "comprising" in the claims and/or the specification may mean "one," but it is also consistent with the meaning of "one or more," "at least one," and "one or more than one." Furthermore, all ranges disclosed herein are inclusive of the endpoints and are independently combinable. In general, unless otherwise indicated, singular elements may be in the plural and vice versa with no loss of generality. As used herein, the term "include" and its grammatical variants are intended to be non-limiting, such that recitation of items in a list is not to the exclusion of other like items that can be substituted or added to the listed items.

It is contemplated that any aspect of the invention discussed in the context of one embodiment of the invention may be implemented or applied with respect to any other embodiment of the invention. Likewise, any composition of the invention may be the result or may be used in any method or process of the invention. This written description uses examples to disclose the invention, including the best mode, and also to enable any person skilled in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

What is claimed is:

1. A method for removing nitrogen compounds from a hydrocarbon feed, comprising:

contacting the feed with an adsorbent comprising at least one organic heterocyclic salt deposited on a porous support selected from the group consisting of molecular sieve, silica, alumina, silica-alumina, carbon, clay and mixtures thereof, thereby resulting in a product containing a reduced amount of nitrogen as compared with the feed and the product has a nitrogen concentration of less than 10 ppm; wherein the feed is selected from any of hydrotreated products, hydrocracked products, coker products, straight run feed, distillate products, FCC bottoms, atmospheric and vacuum bottoms, vacuum gas oils and unconverted oils, the feed has a nitrogen concentration of 3-50 ppm, wherein the adsorbent is stationary in a fixed bed adsorber in a continuous process and no mechanical stirring is applied to the process.

2. The method of claim 1, wherein no external heat is applied to the process.

3. The method of claim 1, wherein the feed contacts the adsorbent at a temperature in the range of 0° C. to 200° C.

4. The method of claim 1, wherein the product contains less than 1 ppm nitrogen.

5. The method of claim 1, wherein the porous support comprises carbon which has been oxidized having a BET surface area of between 200 $m^2/g$ and 3000 $m^2/g$.

6. The method of claim 1, wherein the porous support comprises an inorganic material selected from the group consisting of molecular sieve, silica, alumina, silica-alumina, clay and mixtures thereof having a BET surface area of between 50 $m^2/g$ and 1500 $m^2/g$.

7. The method of claim 1, wherein the porous support comprises pores having an average pore diameter of between 0.5 nm and 20 nm and a pore volume of between 0.1 and 3 $cm^3/g$.

8. The method of claim 1, wherein the organic heterocyclic salt has a general formula of:

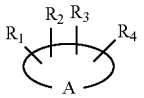

X wherein:

A is a nitrogen cation containing heterocyclic group selected from the group consisting of imidazolium, pyrazolium, 1,2,3-triazolium, 1,2,4-triazolium, pyridinium, pyrazinium, pyrimidinium, pyridazinium, 1,2,3-triazinium, 1,2,4-triazinium, 1,3,5-triazoinium, quinolinium, and isoquinolinium;

$R_1$, $R_2$, $R_3$, and $R_4$ are substituent groups attached to the carbon or nitrogen of the heterocyclic group A, independently selected from the group consisting of hydroxyl, amino, acyl, carboxyl, linear unsubstituted $C_1$-$C_{12}$ alkyl groups, branched unsubstituted $C_1$-$C_{12}$ alkyl groups, linear $C_1$-$C_{12}$ alkyl groups substituted with oxy, amino, acyl, carboxyl, alkenyl, alkynyl, trialkoxysilyl, and alkyldialkoxysilyl groups, branched substituted $C_1$-$C_{12}$ alkyl groups substituted with oxy, amino, acyl, carboxyl, alkenyl, alkynyl, trialkoxysilyl, and alkyldialkoxysilyl groups; and X is an inorganic or organic anion selected from the group consisting of fluoride, chloride, bromide, iodide, aluminum tetrachloride, heptachloroaluminate, sulfite, sulfate, phosphate, phosphoric acid, mono hydrogen phosphate, bicarbonate, carbonate, hydroxide, nitrate, trifluoromethanesulfonate, sulfonate, phosphonate, carboxylate groups of $C_2$-$C_{18}$ organic acids, and chloride or fluoride substituted carboxylate groups.

9. The method of claim 1, wherein the organic heterocyclic salt comprises an imidazolium ion.

10. The method of claim 9, wherein the adsorbent has a denitrification capacity of at least 0.17 mole of nitrogen adsorbed per mole of imidazolium ion.

11. The method of claim 1, wherein the adsorber has a bottom end and top end and the feed is introduced to the adsorber at the bottom end and the product is recovered at the top end.

12. The method of claim 1, further comprising: ceasing the contacting step;

and regenerating the adsorbent by contacting the adsorbent with an aromatics-containing regenerant.

13. The method of claim 12, wherein the adsorbent is regenerated completely in the regenerating step.

14. The method of claim 1, followed by at least one hydroprocessing step selected from hydrotreating, hydrocracking, hydroisomerization and hydrodemetallization.

15. A method for producing a lube oil comprising contacting a hydrocarbon feed with a hydrocracking catalyst, separating the hydrocracked feed into at least one light fraction and a base oil fraction, and contacting the base oil fraction with a bed of isomerization dewaxing catalyst to produce a stream, wherein prior to contacting the hydrocracked feed with the isomerization dewaxing catalyst, the base oil fraction is contacted with an adsorbent comprising an organic heterocyclic salt deposited on a support.

* * * * *